US006558557B1

(12) United States Patent
Gommel et al.

(10) Patent No.: US 6,558,557 B1
(45) Date of Patent: May 6, 2003

(54) PROCESS AND A DECKER FOR BRINGING TOGETHER TWO SUSPENSION LAYERS

(75) Inventors: Axel Gommel, Ravensburg (DE); Josef Schneid, Vogt (DE); Rolf Wenske, Berg (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/249,794

(22) Filed: Feb. 16, 1999

(30) Foreign Application Priority Data

Feb. 17, 1998 (DE) ..... 198 06 402

(51) Int. Cl.[7] ..... B01D 37/00; B01D 33/04; B01D 33/044

(52) U.S. Cl. ..... 210/784; 210/386; 210/402; 162/56; 162/60; 162/189; 162/261; 162/298

(58) Field of Search ..... 162/298, 56, 60, 162/189, 261; 210/783, 784, 386, 402

(56) References Cited

U.S. PATENT DOCUMENTS

| | | | | |
|---|---|---|---|---|
| 4,802,954 A | | 2/1989 | Malashenko | 162/351 |
| 5,196,090 A | | 3/1993 | Corbellini et al. | 210/783 |
| 5,384,014 A | | 1/1995 | Bliss | 210/402 |
| 5,591,336 A | | 1/1997 | Seifert et al. | 210/386 |
| 6,036,029 A | * | 3/2000 | Gommel et al. | 210/402 |
| 6,042,735 A | * | 3/2000 | Gommel et al. | 210/402 |
| 6,106,669 A | * | 8/2000 | Gommel et al. | 210/386 |
| 6,143,133 A | * | 11/2000 | Gommel | 210/400 |

FOREIGN PATENT DOCUMENTS

| | | |
|---|---|---|
| DE | 2824608 | 1/1979 |
| DE | 4225297 | 2/1994 |
| DE | 29510527 | 10/1995 |
| DE | 19542448 | 5/1997 |
| EP | 0376446 | 7/1990 |
| WO | 91/06704 | 5/1991 |

* cited by examiner

*Primary Examiner*—Robert J. Popovics
(74) *Attorney, Agent, or Firm*—Greenblum & Bernstein, P.L.C.

(57) ABSTRACT

Process and decker for bringing together a first aqueous pulp suspension layer with at least one additional suspension layer. The process includes moving the first pulp suspension layer and the at least one additional suspension layer on moving layer supports, and guiding sides of the first pulp suspension layer and the at least one additional suspension layer that are adapted to contact each other on guiding surfaces that are one of stationary and limitedly moving. The guide surfaces include contoured surfaces arranged to run substantially parallel to the layer supports. The process further includes applying the at least one additional suspension layer onto the first pulp suspension layer at a wedge-shaped gap, and draining the first pulp suspension layer and the at least one additional suspension layer. The decker includes at least one rotating cylinder, and an endless wire guided around at least a portion of an outer circumference of the at least one rotating cylinder. The at least one rotating cylinder and the endless wire form a wedge-shaped gap. The decker also includes a first suspension introducing device for introducing a first suspension layer into the wedge-shaped gap, a displacer arranged upstream from the wedge-shaped gap that includes first and second guide surfaces, in which the first guide surface is arranged to be substantially parallel to a portion of the outer circumference of the at least one rotating cylinder adjacent thereto and the second guide surface is arranged to be substantially parallel to a portion of the endless wire adjacent thereto. At least one second suspension introducing device for introducing at least one second suspension layer into the wedge-shaped gap is also provided. The at least one second suspension introducing device is positioned to introduce the at least one second suspension layer upstream of the wedge-shaped gap and between the at least one rotating cylinder and the displacer.

32 Claims, 2 Drawing Sheets

PROCESS AND A DECKER FOR BRINGING TOGETHER TWO SUSPENSION LAYERS

CROSS-REFERENCE TO RELATED APPLICATIONS

The present application claims priority under 35 U.S.C. § 119 of German Patent Application No. 198 06 402.0, filed on Feb. 17, 1998, the disclosure of which is expressly incorporated by reference herein in its entirety.

BACKGROUND OF THE INVENTION

1. Field of the Invention

The present invention is related to a process for bringing together two suspension layers, such that a first aqueous pulp suspension layer is brought together with at least one additional suspension layer. The two suspension layers are transported on moving layer supports to a wedge-shaped gap and drained. The present invention is also related to a decker in which the suspension layers are brought together.

2. Discussion of Background Information

Processes of the type generally discussed above, are used, e.g., in paper production, and, in particular, in the preparation of paper pulp for such production. These processes are generally utilized as intermediate steps in the overall preparation process. A large part of the preparation process is performed in aqueous pulp suspensions, i.e., the paper fibers can be transported in pipes and pumps after being mixed with water. For various reasons, it may be necessary to drain the pulp suspension, e.g., to decker it, for subsequent processes or to wash out undesirable particles. The draining of the suspension often takes place on wire or water-permeable cylinders. In this manner, the water runs off through the openings and the paper fibers that remain behind are deckered.

Such processes have long been known, with the result that there is a large number of different, i.e., more or less complex, processes by which the pulp suspension is drained. In the course of such processes, it is often desired to combine, i.e., to bring together flatly, already drained suspension layers with another suspension layer. In these processes, a mixing of the layers brought together, i.e., an exchange of material between the layers on the contact surfaces, should be avoided. Efforts have been made to avoid mixing by bringing the two layers to roughly a same speed before placing or brining them together. However, it is still not always possible to avoid damaging eddies.

SUMMARY OF THE INVENTION

The present invention provides a process in which it is possible to bring together suspension layers in the manner that largely avoids a mixing between the layers. Further, in special cases, the process may provide for controlled, limited mixing.

In the present invention, the suspension layers are guided on their sides or surfaces adapted for contacting each other, before, and until, being brought together, by guide surfaces that are one of stationary and very limitedly moving. The guide surfaces include contours that are arranged to run substantially parallel to the layer supports.

In the process according to the present invention, two suspension layers are arranged to slide along on the guide surfaces immediately before being brought together. A speed profile which develops has, considering the thickness of the layers, its smallest value in the immediate vicinity of the guide surfaces and its highest value in the vicinity of the layer supports. At a line at which the two layers first touch, the contacting surfaces of the suspension layers have a relatively low speed compared to their surroundings and move virtually parallel to each other. As is known, a laminar aqueous sublayer forms between a moving pulp suspension layer and a guide surface. In this manner, the operating conditions result such that a mixing between the two layers does not occur or is at least negligibly small.

The process according to the present invention finds an important application, particularly when the second suspension layer has a substantially lower solid content than the first pulp suspension layer. Such conditions may be present when filtrate, which contains solid particles which are to be reintroduced into the pulp suspension, is to be added to an already deckered pulp suspension. These solid particles may have been drained off upstream with the filtrate recovered there. If these solid particles are reintroduced into the pulp suspension using the process according to present invention and are drained through the pulp suspension layer, i.e., not in a direction toward a filter-side layer support, the solid particles directed into the filtrate are caught in the pulps suspension, which acts as a filter layer. Further embodiments are also conceivable in which, instead of filtrate and predrained pulp suspension, two pulp suspensions are brought together. In such a situation, it may be advantageous that the layer guided on the permeable layer support be lower in accepts or acceptable solid particles than the other layer (or layers). The layers thus brought together may be later withdrawn, e.g., after they have been further drained, and mechanically destroyed, i.e., torn apart again and often even rediluted. Thus, in these processes, formation of a paper web is not achieved.

Accordingly, the present invention is directed to a process for brining together a first aqueous pulp suspension layer with at least one additional suspension layer that includes moving the first pulp suspension layer and the at least one additional suspension layer on moving layer supports, and guiding sides of the first pulp suspension layer and the at least one additional suspension layer that are adapted to contact each other on guiding surfaces that are one of stationary and limitedly moving. The guide surfaces include contoured surfaces arranged to run substantially parallel to the layer supports. The process further includes applying the at least one additional suspension layer onto the first pulp suspension layer at a wedge-shaped gap, and draining the first pulp suspension layer and the at least one additional suspension layer.

In accordance with another feature of the present invention, the layer support for the first pulp suspension layer is water-permeable and the layer support for the second suspension layer is water-impermeable.

In accordance with another feature of the present invention, the process further includes moving the first pulp suspension and the second suspension layer at a substantially same speed in a region in which the first pulp suspension layer and the second suspension layer are brought together. Further, the substantially same speed is within a tolerance of approximately =10%.

In accordance with still another feature of the present invention, the first pulp suspension layer, at the time the second suspension layer is applied, has an average solid content of at most approximately 10%. Further, the first pulp suspension layer, at the time of the second suspension layer is applied, has an average solid content of at most approximately 4%.

In accordance with still another feature of the present invention, the second suspension layer has a solids content which is at most approximately 20% of a solid content of the first pulp suspension layer.

In accordance with a further feature of the present invention, the process further includes deckering the first pulp suspension layer prior to the wedge-shaped gap, accumulating filtrate from the deckering of the first pulp suspension layer, and applying the accumulated filtrate to a supply for the second suspension layer.

In accordance with a still further feature of the present invention, the process further includes deckering the first pulp suspension layer, accumulating a plurality of filtrate fractions, and using the first accumulated filtrate fraction as an additional suspension layer. Further, the additional suspension layer is composed of a pulp suspension having an accepts content that is greater than that of the first pulp suspension layer.

In accordance with another feature of the present invention, after draining, the process further includes removing the suspension layers from the layer supports, and mechanically destroying the removed layers.

In accordance with still another feature of the present invention, the guide surfaces have polished surfaces.

In accordance with still another feature of the present invention, the guide surfaces have friction-reducing surfaces.

In accordance with a further feature of the present invention, the guide surfaces have water-repellent surfaces.

In accordance with a still further feature of the present invention, the two guide surfaces are joined together in the wedge-shaped gap to form an angle of at most approximately 10.

In accordance with a further feature of the present invention, the moving layer supports are composed of a water-impermeable cylinder and an endless wire partially surrounding the water-impermeable cylinder.

The present invention is also directed to a decker to bring two suspension layers together that includes at least one rotating cylinder, and an endless wire guided around at least a portion of an outer circumference of the at least one rotating cylinder. The at least one rotating cylinder and the endless wire form a wedge-shaped gap. The decker also includes a first suspension introducing device for introducing a first suspension layer into the wedge-shaped gap, a displacer arranged upstream from the wedge-shaped gap that includes first and second guide surfaces, in which the first guide surface is arranged to be substantially parallel to a portion of the outer circumference of the at least one rotating cylinder adjacent thereto and the second guide surface is arranged to be substantially parallel to a portion of the endless wire adjacent thereto. At least one second suspension introducing device for introducing at least one second suspension layer into the wedge-shaped gap is also provided. The at least one second suspension introducing device is positioned to introduce the at least one second suspension layer upstream of the wedge-shaped gap and between the at least one rotating cylinder and the displacer.

In accordance with another feature of the present invention, the at least one rotating cylinder includes a jacket that is smooth on its circumference.

In accordance with still another feature of the present invention, the second guide surface has a radius of curvature of at least approximately 1 m. Further, the second guide surface has a radius of curvature of at most approximately 10 m.

In accordance with a further feature of the present invention, the first guide surface extends to be adjacent to a portion of the circumference that subtends an angle of at least approximately 15°.

In accordance with another feature of the present invention, at least one of the first and the at least one second suspension introducing devices includes a flow box. The flow box may have a broad stream nozzle.

In accordance with a further feature of the present invention, the first suspension introducing device is composed of a flow box arranged to introduce the first suspension layer on the endless wire and upstream from the displacer.

In accordance with a still further feature of the present invention, the at least one rotating cylinder is water-impermeable.

In accordance with still another feature of the present invention, the at least one rotating cylinder includes a first and a second rotating cylinder, such that the first rotating cylinder has a diameter greater than the second rotating cylinder, and the endless wire being guided around the first and the second rotating cylinder. The at least one second suspension layer is introduced between the second rotating cylinder and the displacer, and the first suspension layer is introduced between the first rotating cylinder and the wire.

In accordance with another feature of the present invention, the at least one rotating cylinder includes a first and a second rotating cylinder, such that the first and the second rotating cylinder have a substantially same diameter, and the endless wire is guided around the first and the second rotating cylinder. Each of the first and second rotating cylinder includes a displacer and an associated first and at least one second suspension introducing device.

The present invention is also directed to a process for stacking at least two suspension layers in a decker that includes a rotating cylinder, a wire guided around at least a circumferential portion of the rotating cylinder, and a displacer, positioned between the rotating cylinder and the wire, that includes first and second guide surfaces arranged substantially parallel to adjacent portions of the wire and the rotating cylinder, respectively. The process includes forming a first suspension layer on the wire, forming a second suspension layer between the rotating cylinder and the second guide surfaces, applying the second suspension layer to the first suspension layer downstream of the displacer to form a two layer suspension layer, and draining the two layer suspension layer.

In accordance with another feature of the present invention, the process further including guiding the first suspension layer between the wire and the first guide surface. Further, the process includes moving a surface of the first suspension layer adjacent to the wire at a greater velocity than a surface of the first suspension layer adjacent to the first guide surface. Still further, the process includes moving a surface of the second suspension layer adjacent to the rotating cylinder at a greater velocity than a surface of second suspension layer adjacent to the second guide surface. The first and second guide surfaces are mounted to be one of stationary and for only limited movement.

In accordance with still another feature of the present invention, the process further includes moving a surface of the second suspension layer adjacent to the rotating cylinder at a greater velocity than a surface of second suspension layer adjacent to the second guide surface.

In accordance with a further feature of the present invention, the guide surfaces are stationary surfaces.

In accordance with another feature of the present invention, the guide surfaces are mounted for only limited movement.

In accordance with still another feature of the present invention, the process further including draining the first suspension layer upstream of the displacer, guiding the first suspension between the wire and the first guide surface, and draining the first suspension between the wire and the first guide surface. Further, the process includes accumulating a first filtrate from the draining of the first suspension layer upstream of the displacer and between the wire and the first guide device, and applying the first filtrate to a supply for the second suspension layer. Further still, the process includes accumulating at least one second filtrate from the draining of the two layer suspension layer, and disposing of the at least one second filtrate.

In accordance with yet another feature of the present invention, the process further includes breaking down the drained two layer suspension layer in a macerator device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
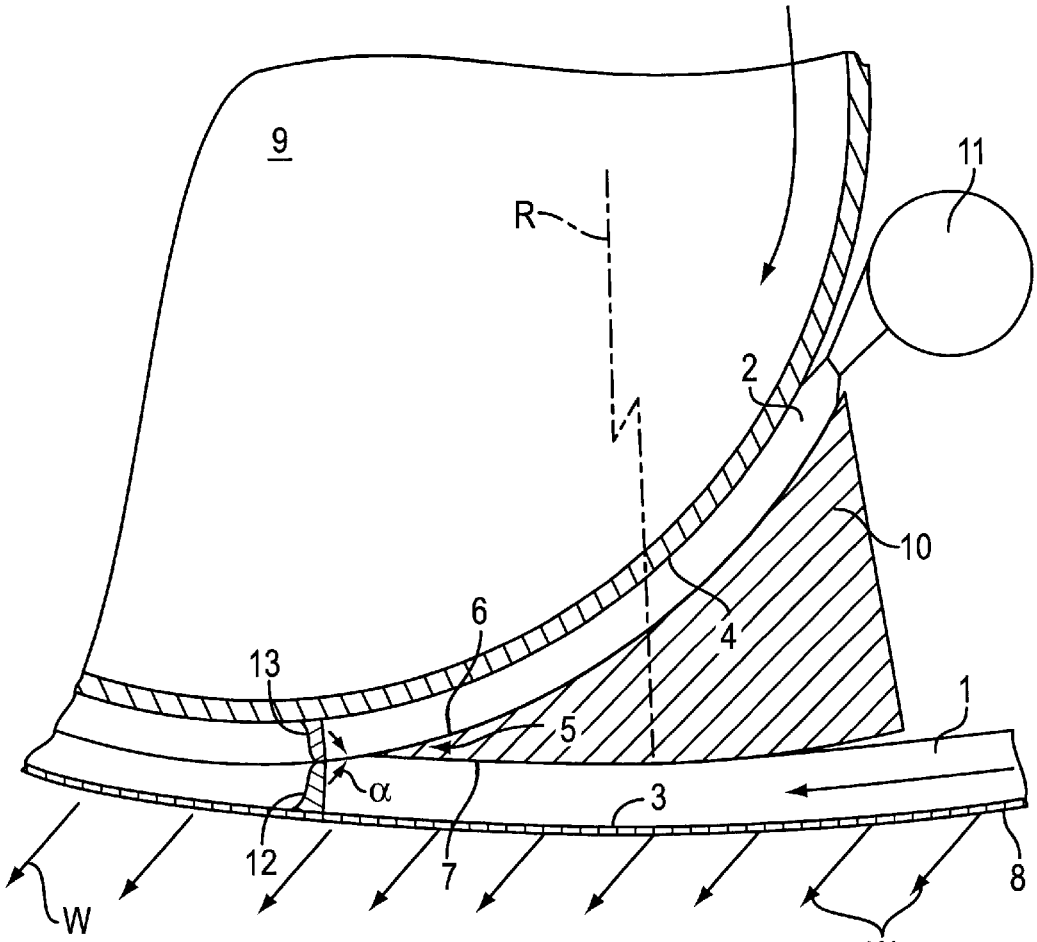
FIG. 1 schematically illustrates a technical implementation of the process according to the present invention.

As illustrated in FIG. 1, a portion of the apparatus, i.e., a decker that removes moisture or water from a pulp suspension, that is utilized to perform the process according to the present invention is schematically depicted. As shown, a first and a second layer support 3 and 4 are provided, in which first layer support 3 may be formed by a flexible endless wire (or screen or sieve) 8 circulating in the machine and second layer support 4 may be formed by an outer jacket of a rotating cylinder 9. The outer jacket may have, e.g., a smooth peripheral surface and may be, e.g., water-impermeable. Layer supports 3 and 4 may be arranged to form a wedge-shaped gap 5, and a displacer 10 may be placed within wedge-shaped gap 5. Displacer 10 may be fixedly positioned or positioned for at least movement to a limited extent, e.g., elastically attached, to be self-adjusting. Displacer 10 may include two guide surfaces 6 and 7, which have contours that run substantially parallel to adjacent support layers 3 and 4, respectively, and which meet at a sharp angle $\alpha$ at the end of wedge-shaped gap 5, which may be at most approximately 10°. Guide surfaces 6 and 7 may be, e.g., polished surfaces, friction-reducing surfaces, and/or water repellent. A front tip of displacer 10 may end in a knife-sharp point or may have a cross-section of a few millimeters. Between layer supports 3 and 4 and the corresponding guide surfaces 7 and 6, channel-like gaps may be formed into which suspension layers 1 and 2 may be guided. It is noted that the depicted dimensions of these gaps have been shown to be excessively large for the purpose of illustration and explanation. Further, the contours of guide surfaces 6 and 7 may, as depicted here, have a curved shape oriented in a same direction. Endless wire 8, which is guided over guide surface 7, exhibits a contour having a radius of curvature R of, e.g., preferably at least approximately 1 meter, but not more than, e.g., approximately 10 meters. In this way, it may be ensured that endless wire 8 makes good contact and generates a surface pressure that results in reliable entrainment of pulp suspension layer 1.

Suspension layer 2 may be sprayed into the gap between second layer surface 4 and guide surface 6 using a flow box 11. Pulp suspension layer 1 may be located on first layer support 3. The two suspension layers may be brought together at approximately a same speed, e.g., within a tolerance of approximately ±10%, as a result of movement of first and second layers supports 3 and 4 (depicted by the movement arrows). The speed of the suspension layers which is developed at the tip of wedge-shaped gap 5 is quantitatively depicted as profiles 12 and 13. It is important for the success of the process of the present invention that the speed development near guide surfaces 6 and 7 is less than the speed developed near layer supports 3 and 4. The significance of this profile has been discussed above. In this connection, it should be noted that suspension layer 2 is not drained in the zone or area between second layer support 4 and guide surface 6, but is drained only after suspension layer 2 has come into contact with pulp suspension layer 1. Downstream from wedge-shaped gap 5, draining occurs with water W flowing radially outwardly through layer support 3. As discussed above, the accepts or solid particles found in suspension layer 2 have a relatively short path through pulp suspension layer 1, which serves for the retention of the useful accepts.

Figure 2:
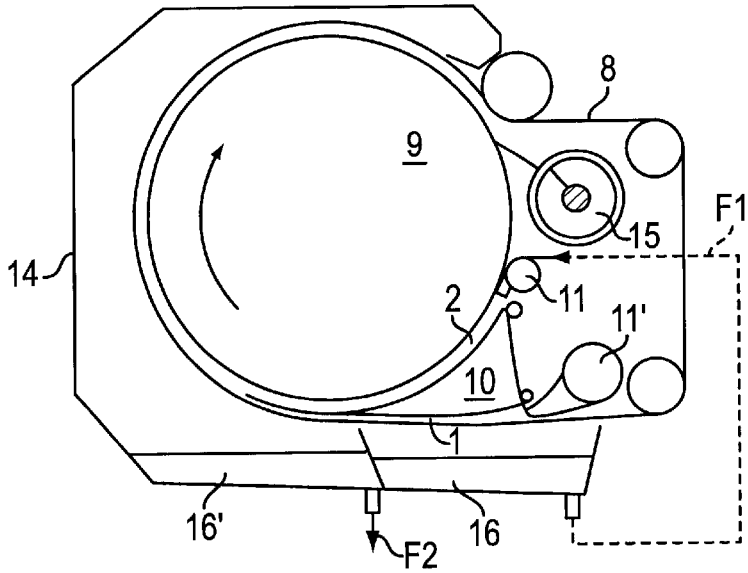
FIG. 2 illustrates the process of the present invention performed in a pulp decker.

FIG. 2 illustrates a decker according to the present invention, in which the bringing together of two suspension layers is performed in accordance with the manner described with reference to FIG. 1. In FIG. 2, cylinder 9 may be surrounded by endless wire 8, and fiber suspension layer 1 may be sprayed onto the endless wire 8 by a flow box 11'. It is also possible that flow box 11' may be arranged a certain distance upstream from displacer 10 so as to prolong the drainage time of suspension layer 1. At this point, it is possible for some of the water to escape through the endless wire 8 with pressing i.e., solely due to the force of gravity. In this way, at the time suspension layer 2 is applied to suspension layer 1, suspension layer 1 may have a solid content of, e.g., at most approximately 10%, and preferably at most approximately 4%. Further, it is noted that suspension layer 2 may have a solid content which is, e.g., at most approximately 20% of the solid content of suspension layer 1.

Once suspension layers 1 and 2 are brought together, they are guided between cylinder 9 and endless wire 8 over a relatively long path, and, thereby, further drained as a result of wire tension and centrifugal force. At a position at which endless wire 8 is deflected from cylinder 9, the two layer pulp suspension remains in concentrated form on the surface of cylinder 9 until it is removed via a doctor or scraper. The removed pulp suspension is then guided into macerator screw 15, which breaks the cohesive layer into relatively small pieces and coveys them in an axial direction out of the machine. In cases in which the solid content of the pulp even after draining is still not so high that a more or less solidly cohesive web has formed, the macerator screw may be omitted and, instead, a pure conveyor screw or another conveyor or device may be used for axial transport.

Water W leaving the suspension layers is collected as filtrate in two separate chambers 16 and 16', which may be formed by the bottom of housing 14. Thus, two filtrates F1 and F2 are accumulated. In a known manner, first filtrate F1, which is the first accumulated filtrate, contains a significant proportion accepts, which in many cases should have remained in the pulp suspension layer 1. To compensate for this loss, filtrate F1 of the first chamber 16 is fed into flow box 11 and is used for the formation of suspension layer 2.

Figure 3:
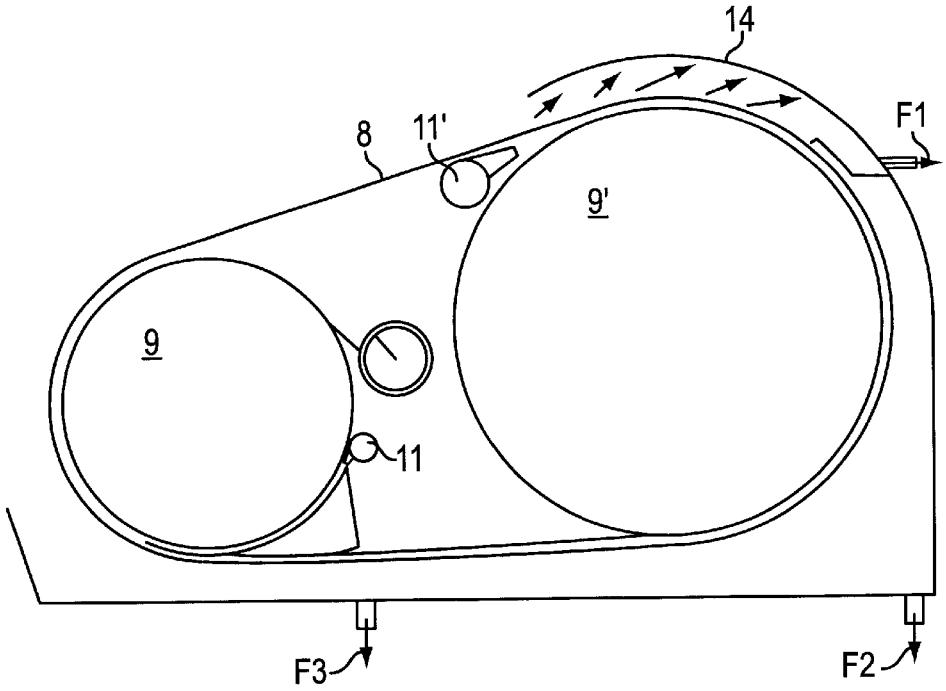
FIGS. 3 and 4 illustrate alternative embodiments of deckers suitable for performing the process of the present invention.

Another decker for performing the process of the present invention is depicted in FIG. 3. This arrangement includes two rotating cylinders 9 and 9', both of which are surrounded by endless wire 8. In this embodiment, the draining of pulp suspension layer 1 occurs over first cylinder 9' and the bringing together of pulp suspension layer 1 with suspension layer 2 occurs at second cylinder 9. Three different filtrates F1, F2, and F3 may be recovered in this embodiment, however, it is noted that this number is for purposes of example only. Generally, it is considered reasonable to accumulate two different filtrates qualities. With the exemplary embodiment depicted here, second cylinder 9 may have a significantly smaller diameter than first cylinder 9'. In this manner, a same wire tension results in greater surface pressure between endless wire 8 and second cylinder 9 than between endless wire 8 and first cylinder 9'. This can be advantageous since, at this point, pulp suspension layer 1 has already been pre-drained, which permits higher surface pressure upon introduction into wedge-shaped gap 5. It is, however, also conceivable that the two cylinders 9 and 9' can be the same size in order to achieve a longer drainage time. It is noted that, while the decker described in this alternative embodiment is generally more expensive than the embodiment depicted in FIG. 2, the decker of FIG. 3 offers significantly greater drainage performance.

Figure 4:
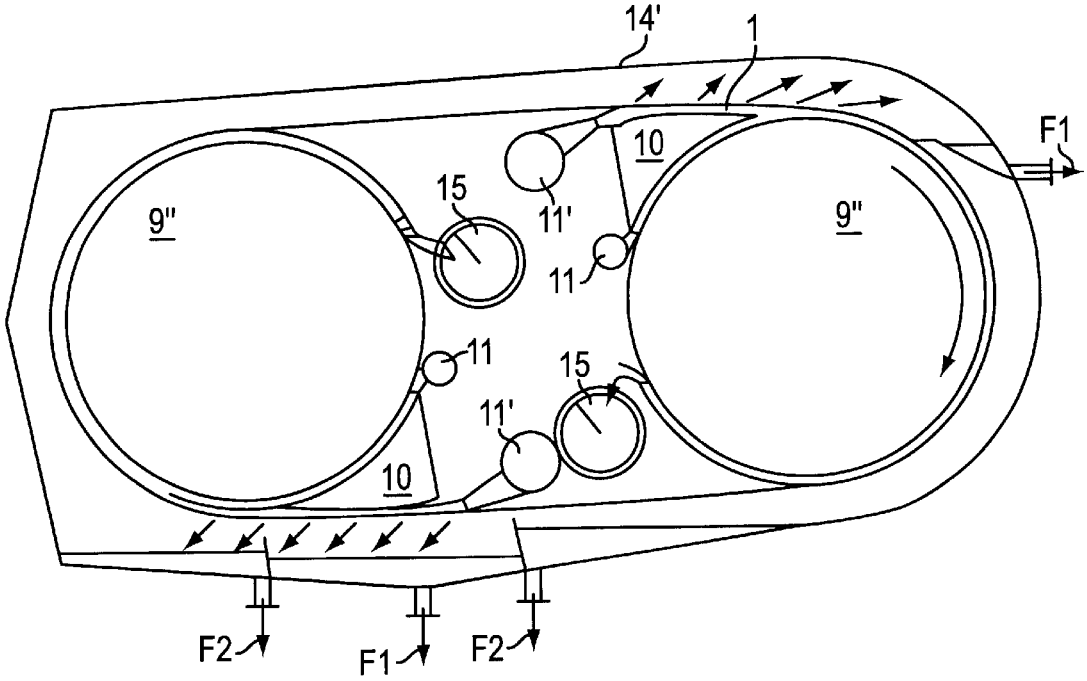

Another alternative embodiment of a decker is depicted in FIG. 4, which enables a further increase in efficiency, thus, allowing the machine to be more compact. This exemplary embodiment includes two cylinders 9", each of which is equipped with a flow box 11 to generate a pulp suspension layer 1 and with a flow box 11' to generate a pulp suspension layer 2. Suspension layers 1 and 2, which are brought together, are subsequently removed from each cylinder in a manner similar to that discussed above.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for bringing together a first aqueous pulp suspension layer with at least one additional suspension layer, composed of an additional aqueous suspension layer, comprising:

moving the first pulp suspension layer and the at least one additional suspension layer on moving layer supports;

guiding sides of the first pulp suspension layer and the at least one additional suspension layer that are adapted to contact each other on guiding surfaces that are stationary or limitedly moving, wherein the guiding surfaces include contoured surfaces arranged to run substantially parallel to the layer supports;

applying the at least one additional suspension layer onto the first pulp suspension layer at a wedge-shaped gap; and draining the first pulp suspension layer and the at least one additional suspension layer.

2. The process according to claim 1, wherein the layer support for the first pulp suspension layer is water-permeable and the layer support for the second suspension layer is water-impermeable.

3. The process according to claim 1, further comprising:

moving the first pulp suspension and the second suspension layer at a substantially same speed in a region in which the first pulp suspension layer and the second suspension layer are brought together.

4. The process according to claim 3, wherein the substantially same speed is within a tolerance of approximately ±10%.

5. The process according to claim 1, wherein the first pulp suspension layer, at the time the second suspension layer is applied, has an average solid content of at most approximately 10%.

6. The process according to claim 5, wherein the first pulp suspension layer, at the time of the second suspension layer is applied, has an average solid content of at most approximately 4%.

7. The process according to claim 1, wherein the second suspension layer has a solid content which is at most approximately 20% of a solid content of the first pulp suspension layer.

8. The process according claim 1, further comprising:

thickening the first pulp suspension layer prior to the wedge-shaped gap;

accumulating filtrate from the thickening of the first pulp suspension layer; and applying the accumulate filtrate to a supply for the second suspension layer.

9. The process according to claim 8, wherein the first pulp suspension layer is thickened without pressing.

10. The process according to claim 8, wherein the first pulp suspension layer is thickened solely by draining via gravity.

11. The process according to claim 1, further comprising:

thickening the first pulp suspension layer;

accumulating a plurality of filtrate fractions; and using the first accumulated filtrate fraction as an additional suspension layer.

12. The process according to claim 11, wherein the additional suspension layer is composed of a pulp suspension having an accepts content that is greater than that of the first pulp suspension layer.

13. The process according to claim 11, wherein the first pulp suspension layer is thickened without pressing.

14. The process according to claim 11, wherein the first pulp suspension layer is thickened solely by draining via gravity.

15. The process according to claim 1, after draining, the process further comprising:

removing the suspension layers from the layer supports; and mechanically destroying the removed layers.

16. The process according to claim 1, wherein the guiding surfaces have polished surfaces.

17. The process according to claim 1, wherein the guiding surfaces have friction-reducing surfaces.

18. The process according to claim 1, wherein the guiding surfaces have water-repellent surfaces.

19. The process according to claim 1, wherein the two guiding surfaces are joined together in the wedge-shaped gap to form an angle of at most approximately 10.

20. The process according to claim 1, wherein the moving layer supports are composed of a water-impermeable cylinder and an endless wire partially surrounding the water-impermeable cylinder.

21. A process for stacking at least two suspension layers in a decker that includes a rotating cylinder, a wire guided around at least a circumferential portion of the rotating cylinder, and a displacer, positioned between the rotating cylinder and the wire, that includes first and second guide surfaces arranged substantially parallel to adjacent portions of the wire and the rotating cylinder, respectively, the process comprising:

forming a first suspension layer, composed of a first aqueous suspension layer, on the wire;

forming a second suspension layer, composed of a second aqueous suspension layer, between the rotating cylinder and the second guide surface;

applying the second suspension layer to the first suspension layer downstream of the displacer to form a two layer suspension layer; and draining the two layer suspension layer.

22. The process according to claim 21, further comprising:

guiding the first suspension layer between the wire and the first guide surface.

23. The process according to claim 22, further comprising:

moving a surface of the first suspension layer adjacent to the wire at a greater velocity than a surface of the first suspension layer adjacent to the first guide surface.

24. The process according to claim 23, further comprising:

moving a surface of the second suspension layer adjacent to the rotating cylinder at a greater velocity than a surface of second suspension layer adjacent to the second guide surface.

25. The process according to claim 24, wherein the first and second guide surfaces are mounted to be stationary or for only limited movement.

26. The process according to claim 21, further comprising:

moving a surface of the second suspension layer adjacent to the rotating cylinder at a greater velocity than a surface of the second suspension layer adjacent to the second guide surface.

27. The process according to claim 21, wherein the guide surfaces are stationary surfaces.

28. The process according to claim 21, wherein the guide surfaces are mounted for only limited movement.

29. The process according to claim 21, further comprising:

draining the first suspension layer upstream of the displacer;

guiding the first suspension between the wire and the first guide surface; and draining the first suspension between the wire and the first guide surface.

30. The process according to claim 29, further comprising:

accumulating a first filtrate from the draining of the first suspension layer upstream of the displacer and between the wire and the first guide device; and applying the first filtrate to a supply for the second suspension layer.

31. The process according to claim 30, further comprising:

accumulating at least one second filtrate from the draining of the two layer suspension layer; and disposing of the at least one second filtrate.

32. The process according to claim 21, further comprising:

breaking down the drained two layer suspension layer in a macerator device.

* * * * *